US005339479A

United States Patent [19]

Lyman

[11] Patent Number: 5,339,479

[45] Date of Patent: Aug. 23, 1994

[54] MOTIVATIONAL TOOTHBRUSH

[76] Inventor: Mark Lyman, 16611 County Hwy. R, Maribel, Wis. 54227

[21] Appl. No.: 141,521

[22] Filed: Oct. 27, 1993

[51] Int. Cl.[5] ..... A46B 9/04

[52] U.S. Cl. ..... 15/105; 15/167.1; 84/94.2; 362/109; 446/404; 446/485; D4/124

[58] Field of Search ..... 15/105, 167.1, 167.2, 15/22.1; 84/94.2; 434/263; 446/71, 72, 79, 81, 397, 404, 408, 485; 362/109, 119, 120; D4/124

[56] References Cited

U.S. PATENT DOCUMENTS

| | | | |
|---|---|---|---|
| 2,800,825 | 7/1957 | Toussaint | 84/94.2 |
| 3,577,579 | 5/1971 | Duve et al. | 15/22.1 |
| 3,835,793 | 10/1974 | Crapio | 362/109 |
| 4,207,673 | 6/1980 | DiGirolamo et al. . | |
| 4,253,212 | 3/1981 | Fujita | 434/263 |
| 4,341,230 | 7/1982 | Siahou . | |
| 4,476,604 | 10/1984 | White et al. | 15/105 |
| 4,698,869 | 10/1987 | Mierau et al. | 15/105 |
| 4,779,173 | 10/1988 | Carr et al. | 15/105 |
| 4,788,734 | 12/1988 | Bauer | 15/105 |
| 4,845,796 | 7/1989 | Mosley | 15/105 |
| 4,866,807 | 9/9189 | Kreit et al. | 15/105 |
| 5,044,037 | 9/1991 | Brown | 15/105 |
| 5,160,194 | 11/1992 | Feldman | 362/109 |

FOREIGN PATENT DOCUMENTS

| | | | |
|---|---|---|---|
| 3149233 | 4/1983 | Fed. Rep. of Germany | 15/105 |

*Primary Examiner*—Timothy F. Simone
*Assistant Examiner*—Mark Spisich
*Attorney, Agent, or Firm*—Russell L. Johnson

[57] ABSTRACT

A child's motivational toothbrush of unitary construction such that no part, of the toothbrush can be nondestructively detached so as to endanger a child. The toothbrush has as a part of its handle construction a three dimensional figure which has a cavity in which an electronic package is sealed, and from which an electronic activation switch is accessible to a user. When the activation switch is pressed the electronic package cycles through a program that produces sounds and electrical impulses that activate lights that blink on and off in a programmed sequence. The intersection between the handle and the toothbrush is provided with and aid for the clean and destructive detachment of the brush end from the handle end so that the brush end can be discarded and the handle end saved.

1 Claim, 1 Drawing Sheet

FIGURE 1
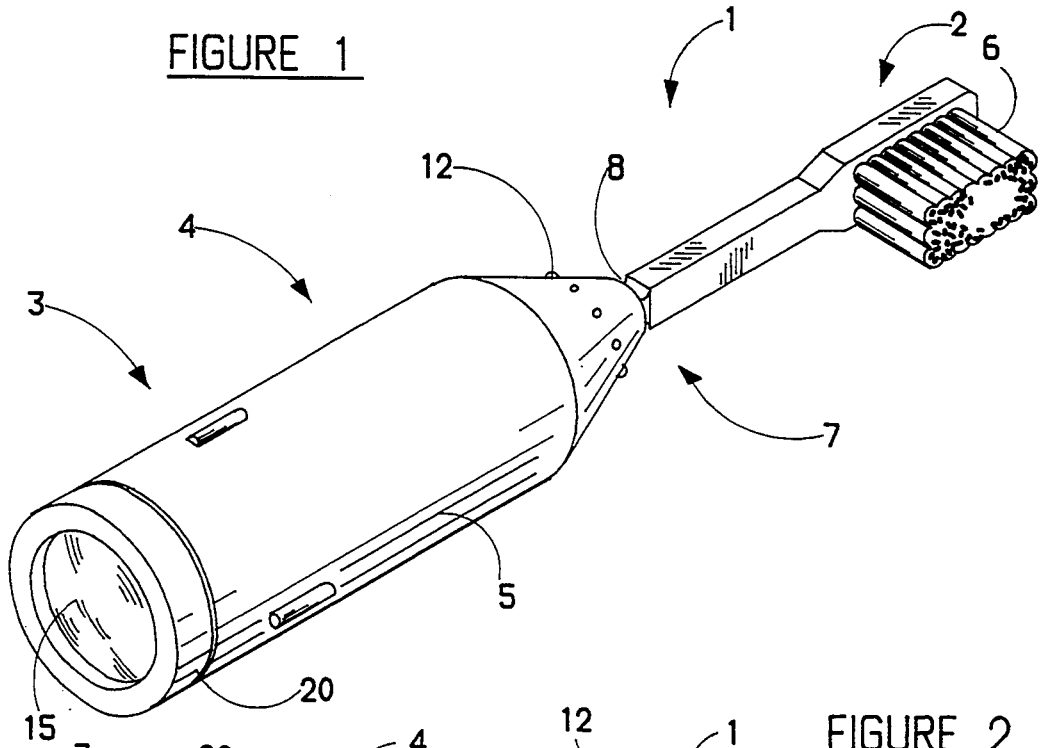
FIGURE 2
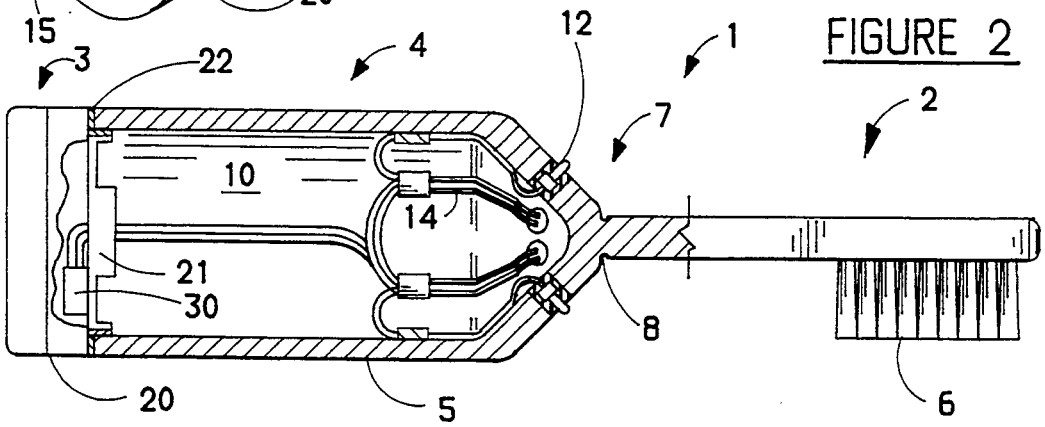
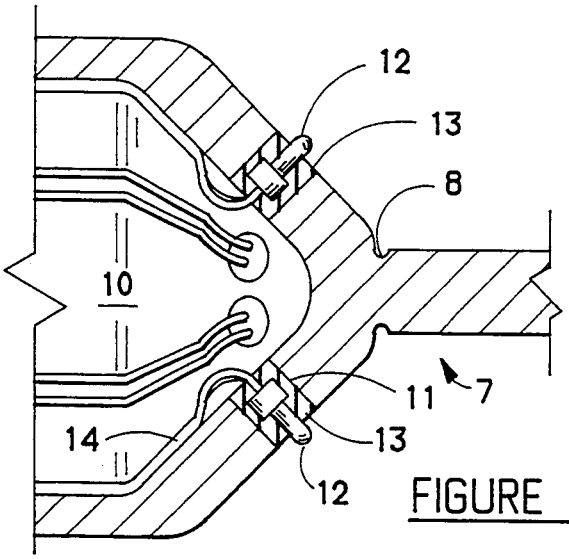
FIGURE 3
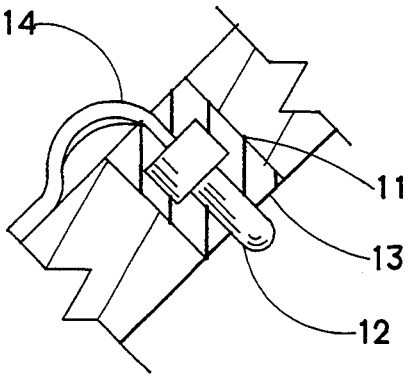
FIGURE 4

MOTIVATIONAL TOOTHBRUSH

FIELD

This invention relates to children's motivational tooth brushes.

BACKGROUND

The teaching of children to practice good dental hygiene should begin at an early age.

Children's tooth brushes are generally smaller in size and have bristles that are configured for use by children.

Children's tooth brushes are also designed to take into account a child's special needs to be protected against harm.

It has been found that children can do a better job of brushing if the griping portion of the tooth brush handle is enlarged to aid griping and manipulating by a child's hands.

It has also been found that children will brush more regularly if the brushing is motivated by various positive sensory perceptions that accompany the brushing.

OBJECTS

It is therefore an object of this invention to provide a combination of positive sensory stimulants in a child's toothbrush.

It is further an object of this invention to provide the above referred to combination wherein the sensory stimulants include visual stimulants and auditory stimulants.

It is further an object of this invention to provide the above referred to combinations wherein the elements of the combinations are incorporated in the tooth brush to form a substantially unitary structure.

It is further an object of this invention to provide the above referred to combinations wherein, the tooth brush can be severed from the handle so as to permit the child to preserve the handle after the tooth brush is worn out.

Other objectives will be made apparent by the following descriptions, drawings, and claims.

PRIOR ART

Motivational children's toothbrushes that provide an audio stimulus are presently available in the art. U.S. Pat. No. 5,044,037 to Brown, and U.S. Pat. No. 4,341,230 to Siahou teach toothbrushes that provide an audio stimulus.

U.S. Pat. No. 4,207,673 to DiGirolalmo et. al. teaches a handle that emits both light and sound and which is configured to interchangeably receive various items of cutlery.

The inventor believes that the prior art does not provide the combination of elements taught by this invention. Further, the applicant believes that at least one of the elements of this invention is not found in the prior art and therefore the combinations of this invention can not be rendered obvious by the teachings of the prior art.

BRIEF DESCRIPTION

The invention in its simplest form provides a tooth brush having a brush at one end and an elongate handle extending from the brush end and the handle has incorporated with it at its opposite end, a three dimensional figure. The three dimensional figure has as a part of its construction an electronic package receiving chamber configured to receive an electronic package. The electronic package is secured in the electronic package receiving chamber so that an electronics activation switch which is a part of the electronics package, is accessible to a user. A multiplicity of lights are secured to the figure and electronically attached to the package so that when the switch is engaged, the electronic package will produce sounds and cause the lights to be activated in a programmed sequence. The tooth brush is of substantially unitary construction such that it provides no parts that can be nondestructively removed from the toothbrush.

The tooth bush is provided with a means for facilitating the destructive removal of the toothbrush from the three dimensional figure so as to permit the saving of the three dimensional figure and its associated electronics when it comes time to discard the toothbrush.

BRIEF DESCRIPTION OF THE DRAWINGS

FIG. 1 is a pictorial view of a tooth brush made according this invention.

FIG. 2 is a partially sectioned elevational view of the toothbrush of FIG. 1.

FIG. 3 is an enlarged segment of FIG. 2.

FIG. 4 is an enlarged segment of FIG. 3.

DETAILED DESCRIPTION

In the figures, like numbers refer to like objects and the proportions of some elements have been exaggerated to facilitate illustration.

FIGS. 1 through 4 illustrate a typical configuration of the invention for which a large number of variants is within the scope of this invention.

Toothbrush 1 has as a part of its structure a combination of interrelated elements.

Toothbrush 1 has a brush end 2 having a brush 6 and a handle end 3 in the form of a three dimensional FIG. 4, which is here shown as a rocket ship 5.

Three dimensional FIG. 4 may take the shape of an object, or a character from literature or entertainment or nature. The number of shapes that FIG. 4 may be given is nearly infinite. It has been found that children readily relate to such figures and are motivated thereby to brush their teeth.

Brush end 2 and handle end 3 of toothbrush 1 come together at intersection 7 which is provided with a detachment aid 8 here shown as a score around intersection 7. Detachment aid 7 serves to facilitate the clean destructive detachment of brush 6 from three dimensional FIG. 4, which permits the child to preserve handle end 3 of toothbrush 1 when brush 6 is ready for replacement. While it would be economically practical to dispose of toothbrush 1, a child's attachment to three dimensional FIG. 4 may make it desirable to preserve handle end 3.

Handle end 3 is provided with cavity 10, and light ports 11 passing between the inside of cavity 10 and the outside of three dimensional FIG. 4. Lights 12 are sealed in ports 11 with epoxy cement or other sealant 13 as shown in detail in FIGS. 3 and 4. Lights 12 are secured in place by sealant 13 so that electrical conductors 14 are within cavity 10 and light from light 12 can be emitted to the outside of three dimensional FIG. 4. Sealant 13 further serves to prevent moisture from entering cavity 10. The construction illustrated in FIGS. 2, 3, and 4 serves to protect lights 12 from breakage and from becoming separated from toothbrush 1 so that light 12 might present a danger to a child.

Electronic package 20 is provided as a sealed package containing a control chip, a sound synthesizer, a switch, a battery, and electrical contacts (all not shown). Diaphragm 15 serves as an actuating switch to cause electronic package 20 to emit sounds and to cause lights 12 to blink on and off in a programmed sequence. Package 20 is provided with projections 21 and circumferential lip 22 which are sealably bondable in a package receiving opening in three dimensional FIG. 4 so as to seal cavity 10 against the entry of water.

A toothbrush made according to this invention is of substantially unitary construction such that no part of the toothbrush can be nondestructively detached so as to endanger a child.

A toothbrush made according to this invention is sealed against moisture entering into the cavity of the toothbrush handle during normal washing and rinsing of the toothbrush.

A toothbrush made according to this invention will provide both sound and light motivations for children to brush their teeth. A toothbrush made according to this invention provides an aid to destructively separating the brush from the three dimensional figure that forms the handle so as to permit the discarding of the brush while preserving the handle.

The above disclosure would enable one skilled in the art to make and use the toothbrush of this invention without undue experimentation.

However, it should be understood that the scope of this invention should not be limited to the embodiment taught, but should only be limited by the scope of the appended claims and all equivalents that would become apparent to one skilled in the art.

What is claimed is;

1. A toothbrush assembly comprising 1) a brush end and a handle end projecting from the brush end, and the brush end and the handle end are of a one-piece construction with each end made of the same material,
2) said handle end defining a three dimensional figure, which defines an intersection between the handle end and the brush end,
3) an electronics package receiving chamber, formed as a part of the handle end of the toothbrush;
4) an electronics package containing a sound synthesizer secured in the chamber so that an electronics initiation switch, which is a part of the electronics package, is accessible to a user, and whereby the sound synthesizer is actuatable by means of said actuation switch,
5) a multiplicity of lights attached to the figure and electrically connected to the electronics package, so that when the switch is engaged the electronics package will produce synthesized sounds and cause the lights to be activated in a preprogrammed sequence, and
6) the toothbrush is of a construction such that none of its parts are detachable during ordinary use,
7) the chamber is sealed against the entry of water during use and cleaning of the toothbrush, and
8) the intersection of the handle end and the brush end is provided with a groove about a substantial portion of its periphery to define a grooved detachment aid to facilitate the detachment of the brush end from the handle end so as to permit the handle end to be preserved and the brush end to be discarded.

* * * * *